US005539501A

United States Patent [19]

Yu et al.

[11] Patent Number: 5,539,501

[45] Date of Patent: Jul. 23, 1996

[54] HIGH SLOPE AC CHARGING DEVICE HAVING GROUPS OF WIRES

[75] Inventors: Zhao-Zhi Yu; James R. Beachner, both of Webster, N.Y.

[73] Assignee: Xerox Corporation, Stamford, Conn.

[21] Appl. No.: 504,982

[22] Filed: Jul. 20, 1995

[51] Int. Cl.[6] ..... G03G 15/02

[52] U.S. Cl. ..... 355/221; 250/324; 361/229

[58] Field of Search ..... 355/219, 221, 355/222, 326 R; 361/213, 212, 225, 229, 230; 250/324–326

[56] References Cited

U.S. PATENT DOCUMENTS

| | | | |
|---|---|---|---|
| 4,445,772 | 5/1984 | Aoki et al. | 355/320 |
| 4,647,179 | 3/1987 | Schmidlin | 361/212 X |
| 4,695,723 | 9/1987 | Minor | 250/325 |
| 5,028,779 | 7/1991 | Gundlach et al. | 355/221 X |

OTHER PUBLICATIONS

Japanese Patent Application No. Hei 1–340663; dated Dec. 28, 1989; Published Sep. 4, 1991; Assigned to Matsushita Denki; Sangyo K.K.

*Primary Examiner*—Arthur T. Grimley
*Assistant Examiner*—Shuk Y. Lee
*Attorney, Agent, or Firm*—John M. Kelly

[57] ABSTRACT

Corona generating devices, and printing machines which use such devices, which include a shell, a plurality of corona wires within the shell, and a power source which outputs first and second alternating voltages which are out-of-phase with each other. The plurality of corona wires are interconnected so as to form two groups of wires. The wires in the first group are operatively connected to the first alternating voltage and the wires in the second group are operatively connected to the second alternating voltage. The corona wires are located within the shell such that wires of the first group are adjacent wires of the second group, and such that wires of the second group are adjacent wires of the first group. The corona generating device beneficially includes a metallic screen which acts as a grid and which controls the corona flow from the corona generating device.

12 Claims, 4 Drawing Sheets

HIGH SLOPE AC CHARGING DEVICE HAVING GROUPS OF WIRES

FIELD OF THE INVENTION

Electrophotographic marking is a well known and commonly used method of copying or creating original documents. Electrophotographic marking is typically performed by exposing a light image of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after an intermediate transfer step, onto a substrate such as a sheet of paper. The transferred toner powder image is then permanently fused to the substrate using heat and/or pressure. The surface of the photoreceptor is then cleaned of residual developing material and recharged in preparation for the creation of another image.

The electrophotographic marking process given above can produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor. Although it might be possible to achieve voltage uniformity by simply recharging previously toned layers to the same voltage level as neighboring untoned areas, an effect referred to as residual toner voltage complicates the process. Residual toner voltage is the voltage difference that occurs between toned areas which have been re-exposed and untoned areas which have been exposed. The residual toner voltage reduces the effective development field in the toned areas, thereby hindering the attempt to achieve a desired uniform consistency of the developed mass of subsequent toner powder images. The problem becomes increasingly severe as additional toner powder images are exposed and developed. Color quality is threatened since the residual toner voltage can cause color shifts, increased moire effects, increased color shift sensitivity to image registration, and toner spreading at image edges. Thus, it is beneficial to reduce or eliminate the residual toner voltage.

Various solutions to the problem of residual toner voltage have been proposed. For example, a co-pending U.S. patent application entitled "Method and Apparatus for Reducing Residual Toner Voltage," Ser. No. 08/347,616 discloses a recharging method and apparatus which uses corotrons, dicorotrons, or other charging devices with highly sloped output current (current applied to the charge retentive surface) versus photoreceptor surface voltage characteristics. However, that system's reduction in residual toner voltage is rather limited.

A recharging method which reduces photoreceptor voltage distribution nonuniformities is described in Japanese Patent application No. Hei 1-340663, Application date 12/29/89, Publication date 9/4/91, assigned to Matsushita Denki Sangyo K. K. That reference discloses a color imaging system which uses two rechargers. The first recharger applies a voltage to the photoreceptor which is higher than the voltage the photoreceptor is to have when it passes to an exposure station. The second recharger reduces the surface voltage of the photoreceptor to that which the photoreceptor is to have when it passes to the exposure station. However, patent application No. Hei 1-340663 teaches that the difference in voltage between those applied by the first and second rechargers is sufficient to insure that the polarity of all toner in the toner powder images is reversed after passing through the rechargers. The net result is a reduction in the residual charge in the toned areas and a reduction in toner spray. Toner spray is a phenomena that occurs when a photoreceptor carrying a toner image is recharged to a relatively high charge level and then exposed. In areas where the edges of prior developed images align but do not overlap with the edges of a subsequent image, the toner of the prior image tends to spray or spread into the subsequently exposed areas (which have a relatively lower charge level). Reversing the polarity of the toner prevents toner spray since the reversed polarity toner is not attracted to the exposed areas.

While the method described in Japanese Patent application No. Hei 1-340663 is effective in reducing residual toner charge and toner spray, when a composite toner powder image comprised of a substantial amount of toner is reversed in polarity, a different problem can develop. After recharging and subsequent exposure, the toner in the prior developed toner powder image has a polarity which is opposite that of both the background untoned areas and the incoming toner which is to form a toner powder image. An interaction occurs among the three distinctly charged regions. For example, in a system having a negatively charged photoreceptor and which uses discharged area development (DAD), the negatively charged toner used for development would be reversed in polarity after recharge using the teachings of Japanese Patent application No. Hei 1-340663. The positively charged toner powder layer would then be attracted to the negatively charged background areas and the incoming negatively charged toner. The positively charged toner then tends to splatter onto neighboring bare background regions. This occurrence is called the "under color splatter" defect (UCS). UCS causes unwanted blending of colors and spreading of colors from image edges onto background areas. Furthermore, a relatively large voltage difference between the first and second rechargers would cause a significant amount of stress to be applied to the photoreceptor. That stress could reduce both the image quality and the life expectancy of the photoreceptor.

Co-pending and commonly assigned U.S. patent application,"Split Recharge Method and Apparatus for Color Image Formation," Ser. No. 08/347,617 discloses a recharging method which attempts to solve the UCS problem. Specifically, U.S. patent application 08/347,617 discloses a split recharge configuration wherein a first corona generating device recharges a charge retentive surface having a developed image thereon to a higher absolute potential than a predetermined potential, and then an alternating current second corona generating device recharges the surface to the predetermined potential. The difference in the photoreceptor surface potential after being recharged by the first corona recharge device and the second corona recharge device is called the "voltage split." Significantly, the alternating current from the second recharger substantially neutralizes the electrical charge associated with the image. The extent of that neutralization depends on the current/voltage slope of the second corona generating device. A higher slope results in a reduced UCS problem. U.S. patent application Ser. No. 08/347,617 also enables a reduced residual toner voltage since the toner voltage is directly proportional to the applied voltage split.

While the teachings of U.S. patent application Ser. No. 08/347,617 are beneficial, any voltage variation on the photoreceptor translates into an objectionable color shift. The voltage variation problem is particularly acute in image-on-image color processing because of the toner mass which must be uniformly charged prior to the exposure and development of the next toner layer. One possible solution to the voltage variation problem would be to increase the charging device's operating slope. By operating slope it is meant the ratio of receptor current (from the charging device) to receptor voltage. Assuming that all other factors remain the same, if the charging device's operating slope is increased any variation in the photoreceptor voltage will induce larger amounts of charge to neutralize those voltage variations. One method of increasing the charging device's operating slope would be to increase the amount of corona available to be delivered to the photoreceptor.

Based on the foregoing, a method and apparatus which increases the amount of corona available to be delivered to a photoreceptor would be highly desirable.

SUMMARY OF THE INVENTION

The present invention provides for an improved corona generating device. That corona generating device includes a shell, a plurality of corona wires within the shell, and a power source which outputs first and second alternating voltages which are out-of-phase with each other. The plurality of corona wires are interconnected so as to form two groups. The wires in the first group are operatively connected to the first alternating voltage, the wires in the second group are operatively connected to the second alternating voltage. The corona wires are located within the shell such that a wire of the first group is adjacent only wires of the second group, and such that a wire of the second group is adjacent only wires of the first group. The corona generating device beneficially includes a metallic screen which acts as a grid and which controls the corona flow from the corona generating device.

The present invention also provides for a printing machine which produces marks on a substrate. That printing machine includes a charge retentive surface capable of being charged and of being subsequently discharged by exposure to radiant energy so as to produce a latent image comprised of greater and lesser electrostatic potentials. The printing machine further includes a charging station for charging the charge retentive surface. That charging station includes a corona generating device which has a shell, a plurality of corona wires within the shell, and a power source which outputs first and second alternating voltages which are out-of-phase with each other. The plurality of corona wires are formed into two groups, a first group and a second group. The wires in the first group are operatively connected to the first alternating voltage, the wires in the second group are operatively connected to the second alternating voltage. The corona wires are located within the shell such that a wire of the first group is adjacent only wires of the second group, and such that a wire of the second group is adjacent only wires of the first group. The corona generating device beneficially includes a metallic screen which acts as a grid and which controls the corona flow from the corona generating device. The printing machine further includes at least one exposure station for exposing the charge retentive surface to radiant energy to produce a latent image on the charge retentive surface and a developing station for transferring toner onto the latent image so as to produce a toner powder image on the charge retentive surface.

The present invention also provides for a method of charging a charge retentive surface. That method includes the steps of passing the charge retentive surface past a corona charging device comprised of a shell, a plurality of corona wires within the shell, and a power source which outputs first and second alternating voltages which are out-of-phase with each other. The plurality of corona wires are formed into two groups: the first group receives the first alternating voltage, the second group receives the second alternating voltage. The corona wires are located within the shell such that a wire in the first group of wires is adjacent only to wires of the second group of wires, and such that a wire in the second group of wires is adjacent only wires of the first group of wires.

BRIEF DESCRIPTION OF THE DRAWINGS

Other aspects of the present invention will become apparent as the following description proceeds and upon reference to the drawings, in which.

Note that in the drawings that like numbers designate like elements.

DETAILED DESCRIPTION OF THE PREFERRED EMBODIMENTS

The embodiments described below relate to imaging systems which produce image on image color outputs. It is to be understood, however, that the present invention is not limited to such embodiments. On the contrary, the present invention is intended to cover all alternatives, modifications and equivalents as may be included within the scope of the appended claims.

Figure 1:
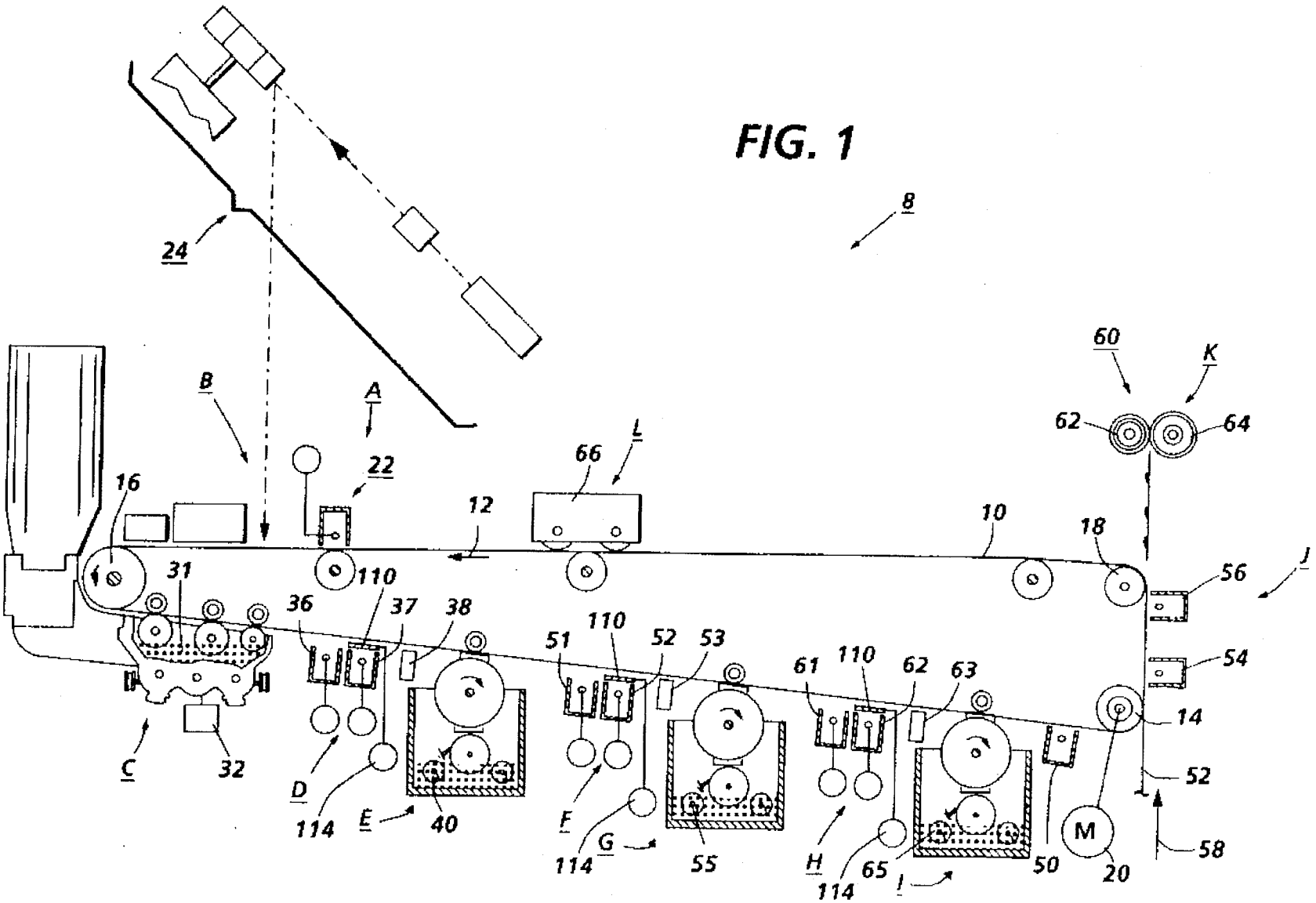
FIG. 1 is a schematic illustration of an electrophotographic printing machine which incorporates the principles of the present invention.

FIG. 1 illustrates an electrophotographic printing machine 8 which incorporates the features of the present invention. The printing machine 8 uses a charge retentive surface in the form of an Active Matrix (AMAT) photoreceptor belt 10 which travels sequentially through various xerographic process stations in the direction indicated by the arrow 12. Belt travel is brought about by mounting the belt about a drive roller 14 and two tension rollers, the rollers 16 and 18, and then rotating the drive roller 14 via a drive motor 20. The printing machine 8 produces a color document in a single pass of the photoreceptor belt.

As the photoreceptor belt moves each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way a description of the processing of one image area suffices to fully explain the operation of the printing machine.

Figure 2A:
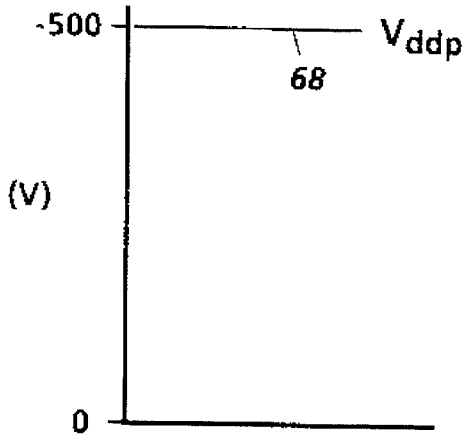
FIG. 2A shows the voltage profile of an image area in the electrophotographic printing machines illustrated in FIGS. 1 and 4 after that image area has been charged.

As the photoreceptor belt 10 moves, the image area passes through a charging station A. At charging station A a direct current pin scorotron 22 charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the subsequently described components are appropriately changed.

Figure 2B:
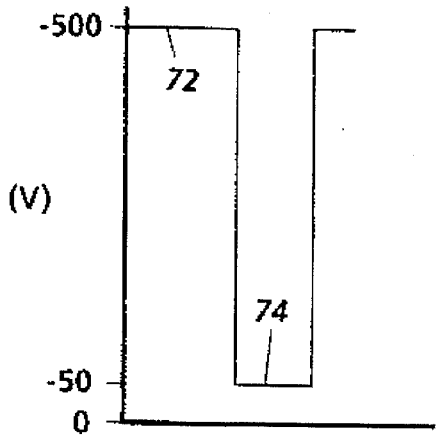
FIG. 2B shows the voltage profile of the image area after being exposed.

After passing through the charging station A the now charged image area passes through a first exposure station B. At exposure station B, the charged image area is exposed to the output of a laser based output scanning device 24 which illuminates the image area with a light representation of a first color (say black) image. That light representation discharges some parts of the image area so as to create an electrostatic latent image. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C. The first development station C is a magnetic brush developer which advances negatively charged insulative magnetic brush (IMB) toner 31 of a first color, say black, onto the image area. The IMB toner is attracted to the less negative sections of the image area and repelled by the more negative sections. The result is a first toner powder image on the image area. To perform its task, the magnetic brush developer includes a plurality of magnetic brush rollers members which advance the IMB toner 31 and a power supply 32 which charges the IMB toner to the required potential.

Figure 2C:
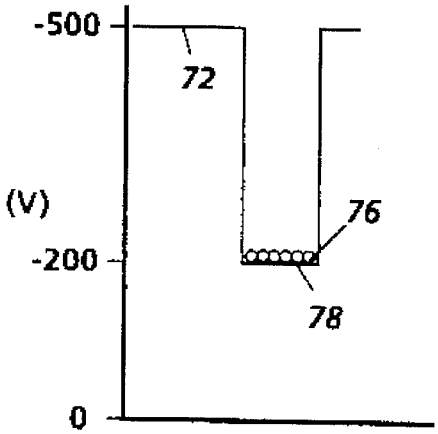
FIG. 2C shows the voltage profile of the image area after being developed.

FIG. 2C shows the voltages on the image area after the image area passes through the first development station C. Toner 76, which is charged to a negative voltage of about −200 volts, adheres to the illuminated image area. This causes the voltage in the illuminated area to increase to about −200 volts, as represented by the solid line 78. The unilluminated parts of the image area remain at the level 72.

After passing through the first development station C, the now exposed and toned image area passes to a first recharging station D. The first recharging station is beneficially comprised of two corona charging devices, a first charging device 36 and a second charging device 37, which act together to recharge the voltage levels of both the toned and untoned parts of the image area to a substantially uniform level. While the first charging device 36 is beneficially the same as, or very similar to, the direct current pin scorotron 22, the second charging device 37 is a multiple wire AC scorotron.

Figure 3A:
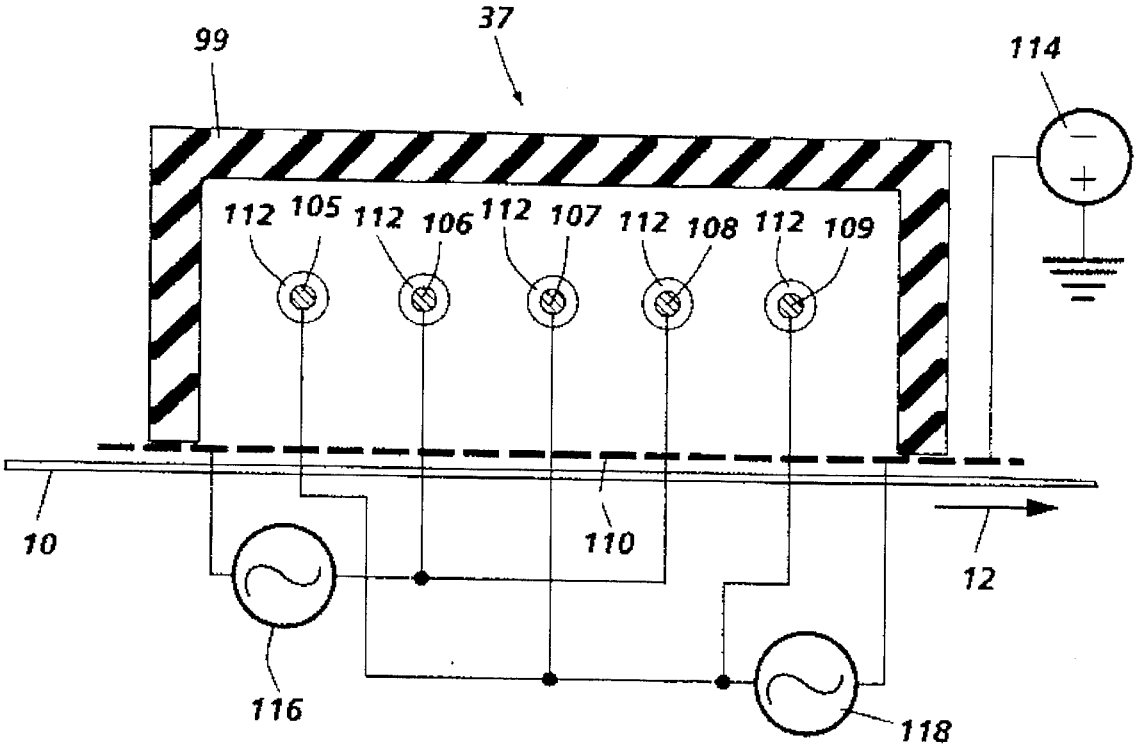
FIG. 3A schematically depicts a preferred embodiment charging device according to the principles of the present invention.

An exemplary second charging device 37 is depicted in FIG. 3A. As shown, the charging device includes an insulative shell 99 which houses a plurality of corona wires, the wires 105, 106, 107, 108, and 109, and a metallic grid 110. Beneficially all of the corona wires are coated with a dielectric material 112 such as glass.

Figure 3B:
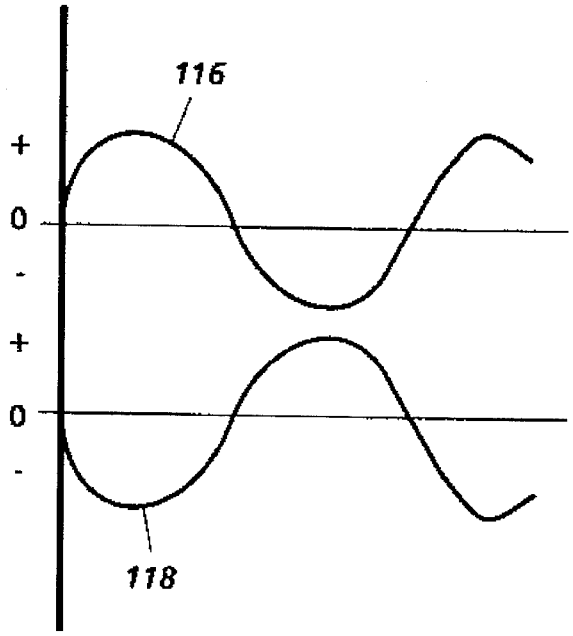
FIG. 3B illustrates corona wire drive voltages.

In operation, the metallic grid 110 is negatively charged by a power source 114. A first alternating current power source 116 applies an alternating voltage to a first group of the corona wires, in FIG. 3A the wires 106 and 108. A second alternating current power source 118 applies an alternating voltage to a second group of the corona wires, in FIG. 3A the wires 105, 107, and 109. FIG. 3B graphically illustrates a beneficial phase relationship between the alternating current power sources, that relationship being 180 degrees out of phase. In practice, the alternating voltages may be at 5.3 KVolts at a frequency of about 4 KHz. Of course, the present invention may be used with other voltages, frequencies, and waveforms (such as squarewaves).

Figure 2D:
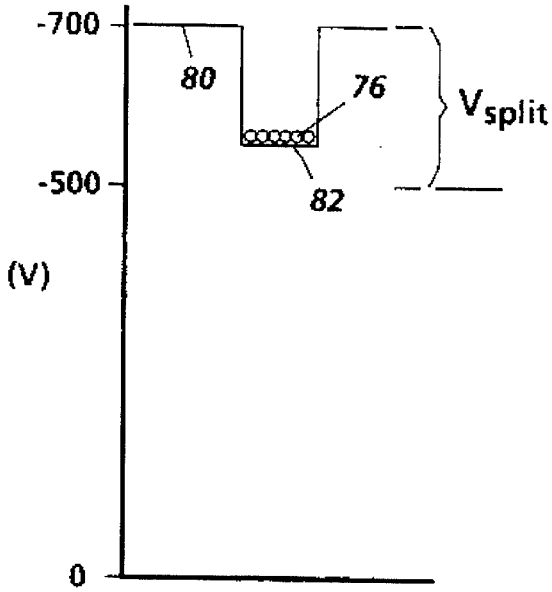
FIG. 2D shows the voltage profile of the image area after being recharged by a first charging device.

As the image area passes through the first recharging station D, corona generated in the first charging device 36 is transferred to the image area. The first charging device is designed to overcharge the image area and its toner particles to more negative voltage levels than that which the image area and toner particles are to have when they leave the recharging station D. For example, as shown in FIG. 2D the untoned parts of the image area reach a voltage level 80 of about −700 volts. However, because of differences in the charge characteristics of the untoned parts of the image area and of the toned parts, the toned parts, represented by toner 76, while being charged to a level 82 which is more negative than −500 volts, do not reach 700 volts.

Figure 2E:
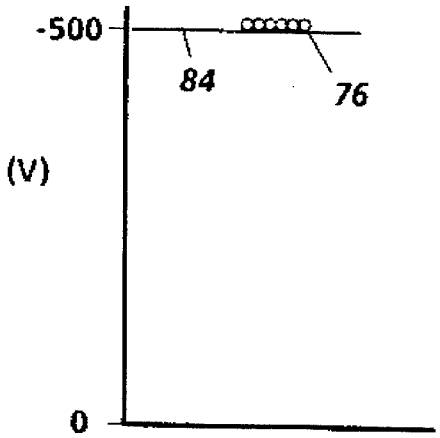
FIG. 2E shows the voltage profile of the image area after being recharged by a second charging device.

After being charged by the first charging device 36, the image area passes the second charging device 37. The second charging device 37 is designed to reduce the voltages of the image area, both the untoned parts and the toned parts (represented by toner 76) to a level 84 which is the desired potential of −500 volts. See FIG. 2E. Thus, the voltage split, the difference in the voltages on the untoned parts of the image area after leaving the first charging device 36 as compared to after leaving the second charging device 37, is −200 volts.

An advantage of the second charging device 37 is that it has a high operating slope: a small voltage variation on the charge retentive surface can result in large charging currents being applied to the charge retentive surface. The voltage applied to the metallic grid 110 can be used to control the voltage at which charging currents are supplied to the image area from the second charging device 37. A disadvantage of the second charging device 37 is that it, like other AC operated charging devices, tends to generate much more ozone than comparable DC operated charging devices.

Figure 2F:
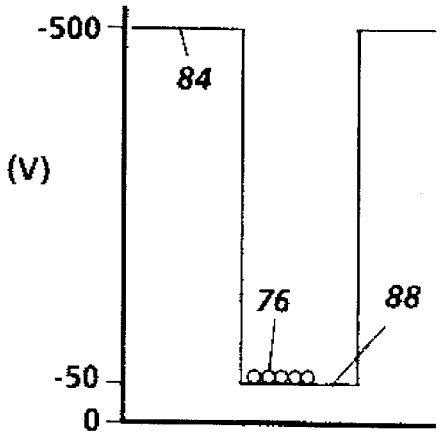
FIG. 2F shows the voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, the illuminated areas, both the previously toned areas denoted by the toner 76 and the untoned areas are discharged to about −50 volts as denoted by the level 88.

After being exposed at the second exposure station 38 the image area passes to a second development station E. The second development station E is beneficially a scavengeless development station. Scavengeless development stations are well known and are described in U.S. Pat. No. 4,984,019 entitled, "Electrode Wire Cleaning," issued Jan. 3, 1991 to Folkins; in U.S. Pat. No. 4,868,600 entitled "Scavengeless Development Apparatus for Use in Highlight Color Imaging," issued Sep. 19, 1989 to Hayes et al.; in U.S. Pat. No. 5,010,367 entitled "Dual AC Development System for Controlling The Spacing of a Toner Cloud," issued Apr. 23, 1991 to Hays; in U.S. Pat. No. 5,253,016 entitled, "Contaminant Control for Scavengeless Development in a Xerographic Apparatus," issued to Behe et al. on Oct. 12, 1993, and in U.S. Pat. No. 5,341,197 entitled, "Proper Charging of Doner Roll in Hybrid Development," issued to Folkins et al. on Aug. 23, 1994. Those patents are hereby incorporated by reference. The benefit of using scavengeless development at the second development station E is that the previously deposited first toner layer is undisturbed by the development of the second toner layer. At the second development station E toner 40 which is of a different color (yellow) than the toner 31 in the first development station C is attracted onto the less negative parts of the image area and repelled by the more negative parts. After passing through the second development station E the image area has first and second toner powder images which may overlap.

After passing through the second development station E the image area passes to a second recharging station F. The second recharging station F has first and second charging devices, the devices 51 and 52 which, respectively, operate the same as the charging devices 36 and 37 described above. Briefly, the first charging device 51 is a DC corotron which overcharges the image areas to a greater absolute potential than that ultimately desired. The second charging device 52 is the same as the charging device 37 shown in FIG. 3A and described above. The second charging device neutralizes that overcharged image area to that ultimately desired (about −500 volts).

After passing through the second recharging station F the recharged image area passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color toner 55 (magenta) contained in a third developer station G. The third developer station G is beneficially a scavengeless development system similar to the second development station E.

After passing through the third developer station G the image area passes through a third recharging station H. The third recharging station includes a pair of corona charge devices 61 and 62 which adjust the voltage level of both the toned and untoned parts of the image area to a substantially uniform level in the same manner as the charging devices 36 and 37 and the charging devices 51 and 52.

After passing through the third recharging station H the recharged image area passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth developer station I. The fourth developer station I is beneficially a scavengeless development system similar to the second development station E and to the third development station G.

To condition the toner for effective transfer to a substrate, the image area then passes to a negative pre-transfer corotron member 50 which delivers negative corona to ensure that all toner particles are of the required negative polarity. The pre-transfer corotron is beneficially a device or devices similar to the corona generating device 22.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a heated pressure roller 64. When the support sheet 52 passes between the fuser roller 62 and the pressure roller 64 the toner powder is permanently affixed to the sheet support 52. After fusing a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

If black toners are developed first (as described above) one of the two charging devices 36 and 37 could be eliminated. This is because color toner is not usually developed over black toner.

Figure 4:
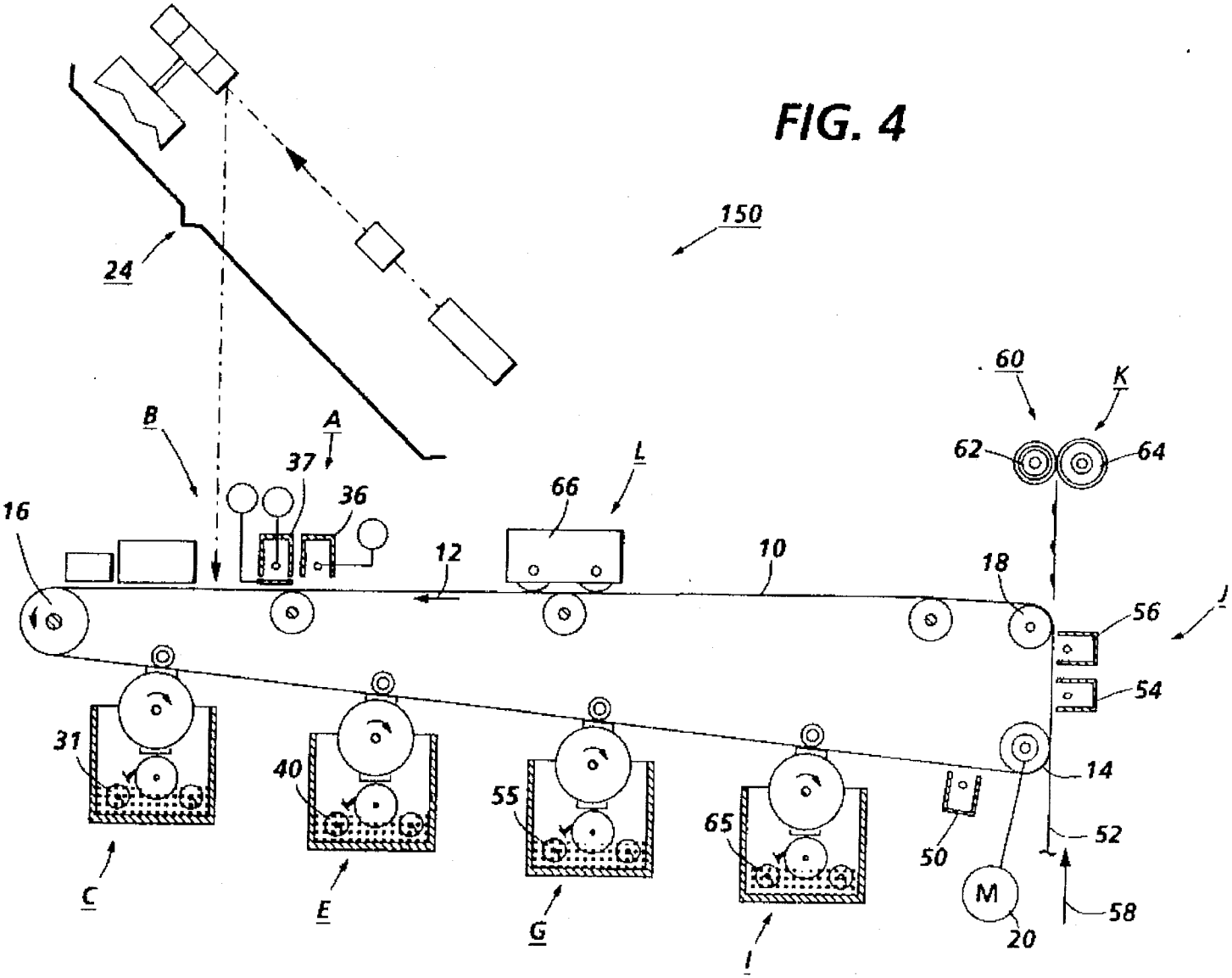
FIG. 4 is a schematic illustration of another electrophotographic printing machine which incorporates the features of the present invention.

FIG. 4 illustrates an electrophotographic printing machine 150 which is also in accord with the principles of the present invention. The printing machine 150 creates a color image by passing an image area four times through the machine, one pass for each color toner.

As in the printing machine 8, the printing machine 150 uses a charge retentive surface in the form of an Active Matrix (AMAT) photoreceptor belt 10 which travels sequentially through various xerographic process stations in the direction indicated by the arrow 12. Belt travel is brought about in the same way as in printing machine 8.

As the photoreceptor belt moves an image area (described above in relation to the printing machine 8) passes through a charging station A. As shown, the charging station A includes two corona charging devices, a first charging device 36 and a second charging device 37 (which are the same as the charging devices 36 and 37 previously described). However, during the first pass of the image area through the printing machine 150 the image area does not have any toner on it. Thus split charging is not required and only one of the charging devices needs to be used to charge the image area. FIG. 2A shows the voltage profile 68 on the image area after it passes through the charging station A for the first time.

After passing through the charging station A the charged image area passes to an exposure station B. At exposure station B the image area is exposed to the output of a laser based output scanning device 24 which illuminates the image area with a light representation of an image. During the first pass through the exposure station B the image area is exposed to create an electrostatic latent image of a first color, say black. FIG. 2B shows typical voltage levels, the levels 72 and 74, which might exist on the image area after exposure.

After passing through the exposure station B for the first time, a first development station C deposits a first toner powder image of a first color, black, on the image area. While the first development station C could be a magnetic brush developer as used in the printing machine 8, it could also be a scavengeless developer (as shown in FIG. 4). In either case toner 31 is advanced onto the image area. The toner is attracted to the less negative sections of the image area and repelled by the more negative sections. FIG. 2C shows the voltages on the image area after the image area passes through the first development station C. Toner, represented by element 76, which is charged to a negative voltage of about −200 volts, adheres to the illuminated image area. This causes the voltage in the illuminated area to increase to about −200 volts, as represented by the solid line 78. The non-illuminated parts of the image area remain at the level 72.

After passing through the first development station C the image area advances so as to return to the charging station A for recharging. As was previously mentioned the charging station A is comprised of two corona charging devices, a first charging device 36 and a second charging device 37. While only one of the charging devices was needed to initially charge the image area, during recharging the charging devices work together to recharge the voltage levels of both the toned and untoned parts of the image area to a substantially uniform level. The recharging of the image area proceeds in the manner described above with reference to the charging stations 36 and 37 in the printing machine 8. Reference FIG. 2D (which shows the voltages on the image area after it passes the first charging device 36) and FIG. 2E (which shows the voltage on the image area after passing the second charging device 37). Again, the voltage split is about −200 volts.

After being recharged at charging station A, the now substantially uniformly charged image area with its first toner powder image again passes the exposure station B. Except for the fact that the exposure station illuminates the image area with a light representation of a second color image (say yellow) so as to create a second electrostatic latent image, the exposure station operates in the same manner as it did during the first pass of the image area. FIG. 2F illustrates the potentials on the image area after it passes through the exposure station the second time.

After passing through the exposure station B for the second time the image area advances to a second development station E which deposits a second toner powder image of a second color of toner 40, yellow, on the image area. As in the printing machine 8, the second development station E beneficially is a scavengeless developer. The toner 40 is attracted to the less negative parts of the image area and repelled by the more negative parts. After passing through the second development station E the image area has first and second toner powder images which may overlap.

The image area then advances once again to charging station A for recharging. The charging station A recharges the image area in the same manner as it did when the image area passed through the charging station the second time. The substantially uniformly charged image area with its two toner powder images then passes through the exposure station B. The exposure station B illuminates the image area with a light representation of a third color image (say magenta) so as to create a third electrostatic latent image.

The exposed image area then advances to a third development station G which deposits a third toner powder image of a third color toner 55, magenta, on the image area. The third development station G, indicated generally by the reference numeral 57, is a scavengeless developer which advances the toner 55 onto the image area.

Once again the image area advances to charging station A for recharging. The charging station A again recharges the image area in the same manner as previously described. The substantially uniformly charged image area with its three toner powder images then again passes the exposure station B. The exposure station B illuminates the image area with a light representation of a fourth color image (say cyan) so as to create a fourth electrostatic latent image.

The image area then advances to a fourth development station I which deposits a fourth toner powder image of a fourth color toner 65, cyan, on the image area. The fourth development station I is also a scavengeless developer.

After the fourth toner powder image is developed the composite toner powder image is ready for transfer to the a support sheet 52 and subsequent fusing. Transfer to the support sheet, fusing, and cleaning of the photoreceptor belt 10 are performed in the same manner as previously described with reference to the printing machine 8. The image area is then ready to begin a new marking cycle.

While the foregoing descriptions were directed to full color printing machines, it will be appreciated that high slope AC scorotron devices with groups of wires are useful in numerous other applications. For example, such devices should be beneficial in use as pretransfer corona generating devices, particularly in high speed trilevel electrophotographic printing machines.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A corona generating device for charging a charge retentive surface, comprising:

a shell;

a plurality of first corona wires and a plurality of second corona wires, said plurality of first corona wires and said plurality of second corona wires being positioned within said shell such that each of the first corona wires is adjacent only second corona wires and such that each of the second corona wires is adjacent only first corona wires; and a power source operatively connected to the first and second corona wires, the power source for applying a first alternating voltage to the first corona wires and for applying a second alternating voltage to the second corona wires which is out-of-phase with the first voltage.

2. The corona generating device according to claim 1, wherein at least one of the first corona wires comprises a dielectric coating.

3. The corona generating device according to claim 2, wherein the dielectric coating comprises glass.

4. The corona generating device according to claim 1, further comprising a metallic screen adjacent the first corona wires and the second corona wires, the metallic screen being biased to a screen potential and for controlling corona flow from the corona generating device to the charge retentive surface in response to the screen potential.

5. The corona generating device according to claim 1, wherein said first voltage and said second voltage are substantially 180 degrees out-of-phase.

6. A printing machine, comprising:

a charge retentive surface capable of being charged to a predetermined potential of a first polarity and of being subsequently exposed to radiant energy so as to produce a latent image comprised of greater and lesser potentials of the first polarity;

a charging station for charging the charge retentive surface to the predetermined potential, the charging station having a corona generating device with a shell and a plurality of first corona wires and a plurality of second corona wires within said shell, said plurality of first corona wires and said plurality of second corona wires being positioned within the shell such that each of the first corona wires is adjacent only second corona wires and such that each of the second corona wires is adjacent only first corona wires, the charging station further including a power source operatively connected to the first corona wires and the second corona wires, the power source for applying a first alternating voltage to the first corona wires and for applying a second alternating voltage which is out-of-phase with the first voltage to the second corona wires;

a first exposure station for exposing the charge retentive surface to produce a first latent image on the charge retentive surface; and a first developing station for transferring toner onto the first latent image so as to produce a first toner powder image on the charge retentive surface.

7. The corona generating device according to claim 6, wherein at least one of the first corona wires comprises a dielectric coating.

8. The corona generating device according to claim 7, wherein the dielectric coating comprises glass.

9. The corona generating device according to claim 6, further including a metallic screen adjacent the first corona wires and the second corona wires, the metallic screen for receiving a screen potential and for controlling corona flow from the corona generating device to the charge retentive surface in response to the screen potential.

10. The corona generating device according to claim 6, wherein said first voltage and said second voltage are substantially 180 degrees out-of-phase.

11. The printing machine according to claim 6, further including:

a recharging station for recharging the charge retentive surface after the charge retentive surface passes through the first developing station;

a second exposure station for exposing the charge retentive surface to produce a second latent image on the charge retentive surface, and second developing station for transferring toner onto the second latent image so as to produce a second toner powder image on the charge retentive surface.

12. The printing machine according to claim 11 wherein the second exposure station and the first exposure station are the same station.

* * * * *